United States Patent [19]

Hernandez

[11] 4,184,276

[45] Jan. 22, 1980

[54] MOTOR VEHICLE REGISTRATION CARD HOLDER

[76] Inventor: Albert Hernandez, 465 Ocean Pkwy., Brooklyn, N.Y. 11218

[21] Appl. No.: 842,062

[22] Filed: Oct. 14, 1977

[51] Int. Cl.[2] ..... G09F 3/00

[52] U.S. Cl. ..... 40/10 A; 40/593

[58] Field of Search ..... 40/10 A, 10 B, 10 D, 40/591, 593, 152, 201

[56] References Cited

U.S. PATENT DOCUMENTS

| | | | |
|---|---|---|---|
| 2,093,598 | 9/1937 | Clark | 40/10 A |
| 2,223,308 | 11/1940 | Rovell | 40/152.1 |
| 2,535,265 | 12/1950 | Caffrey | 40/10 A |
| 2,887,804 | 5/1959 | Wise | 40/593 |
| 2,968,109 | 1/1961 | Timmins | 40/152.1 |
| 3,313,053 | 4/1967 | Vogeli, Sr. | 40/593 X |
| 3,533,178 | 10/1970 | Strohmaier | 40/593 X |
| 3,555,712 | 1/1971 | Yargeau | 40/593 |
| 3,771,244 | 11/1973 | Ebner | 40/152 |

FOREIGN PATENT DOCUMENTS

| | | | |
|---|---|---|---|
| 1201051 | 12/1959 | France | 40/593 |

*Primary Examiner*—John F. Pitrelli
*Assistant Examiner*—G. Lee Skillington
*Attorney, Agent, or Firm*—Brumbaugh, Graves, Donohue & Raymond

[57] ABSTRACT

A U-shaped holder made of a light flexible material having grooves in the inside walls and bottom thereof forming a slot to receive an automobile registration card or plate. Affixed to one face of the holder is a layer of flexible material coated with a pressure sensitive adhesive to facilitate securing the holder to the windshield of an automobile.

2 Claims, 5 Drawing Figures

MOTOR VEHICLE REGISTRATION CARD HOLDER

BACKGROUND OF THE INVENTION

This invention relates to holders for cards and the like and more particularly to a new and improved holder for an automobile registration card and the like which is adapted to be affixed to the windshield of a motor vehicle.

With the advent of motor vehicles, each state in the Union developed a motor vehicle registration system which serves the dual purpose of identifying motor vehicles and providing revenues from registration fees. The universal registration system is the license plate which is secured either to the front and rear bumpers of a motor vehicle or, in some states, to the rear bumper only. Additional identification such as the registration sticker which is affixed to the inside of the windshield of the motor vehicle is required in some states. State law often provides that these identification devices be renewed yearly. Accordingly, the continued use of expired identification devices, or the absence of any identification device, indicates to the authorities that the motor vehicle is being operated illegally.

Because of their exposure on the outside of the motor vehicle, license plates must be securely fastened to the vehicle. As such, they are not readily removable. Adhesive coated registration stickers, affixed to the windshield of a motor vehicle, cannot be removed without either mutilating or destroying the sticker. These registration identification devices are specifically designed to prevent ready and convenient removal from the motor vehicle.

In the interest of deterring automobile theft and the unauthorized operation of a motor vehicle without a proper registration, it would be desirable to provide a highly visible registration card or plate that could be prominently displayed inside an automobile when the driver is present and easily removed by him when he leaves the vehicle. Apparatus suitable for this purpose, however, has not been available heretofore.

It is known in the art to provide a metal frame to be attached by brackets to the moldings on the inside of the windshield of a car into which a transparent card can be inserted. In the rear of this assembly is a device which, when activated, illuminates the transparent card. The complexity, expense and bulk of this system, however, diminishes its usefulness as a practical means of identifying motor vehicles. Moreover, because of its size and complexity, it cannot conveniently be installed by the owner.

Also, illuminated roof mounted identification signs have long been commonly used on taxicabs. While these signs often identify a taxicab by call number, their purpose is to indicate to the pedestrian whether a cab is occupied, off duty or available for hire. The use of this type of device on an automobile is prohibitively expensive and aesthetically displeasing. Moreover, such a device is permanently installed on the roof of the vehicle and cannot be readily removed by the operator when the vehicle is not being used.

It is an object of the present invention, accordingly, to provide a compact, inexpensive and convenient device for identifying a motor vehicle that can be easily installed on the windshield by the owner of the vehicle without appreciably diminishing the driver's visibility.

Another object of the invention is to provide a new and improved card holder that is light in weight and easy and inexpensive to manufacture.

SUMMARY OF THE INVENTION

These and other objects of the invention are attained by providing a holder composing a sturdy but lightweight and slightly flexible U-shaped frame having substantially coplanar grooves formed in the inside walls and bottom leg within which a registration card or plate is adapted to be removably received. To one face of the holder is affixed a layer of flexible material coated with a pressure sensitive adhesive by means of which it may be firmly secured to the inside of a car windshield, for example.

DESCRIPTION OF A PREFERRED EMBODIMENT

For a better understanding of the invention, reference may be made to the following description of an exemplary embodiment taken in conjunction with the accompanying drawings, in which.

Figure 1:
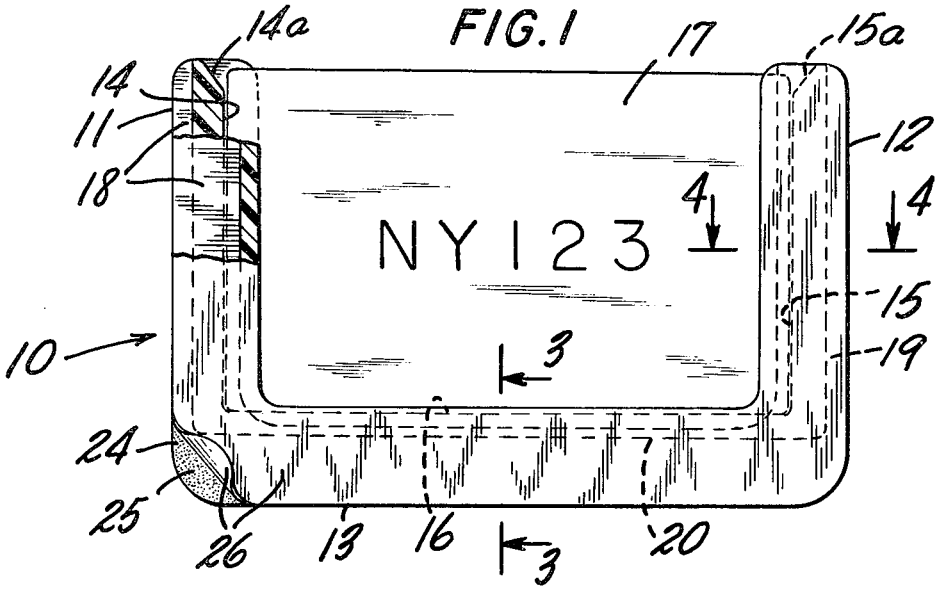
FIG. 1 is a front view of a car registration holder constructed according to the invention with a registration card or plate therein.
Figure 3:
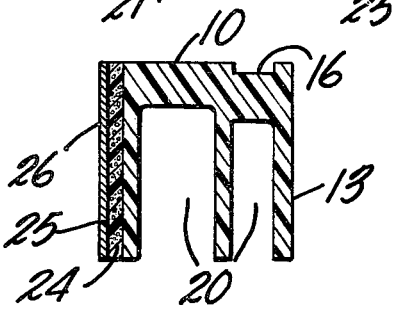
Figure 4:
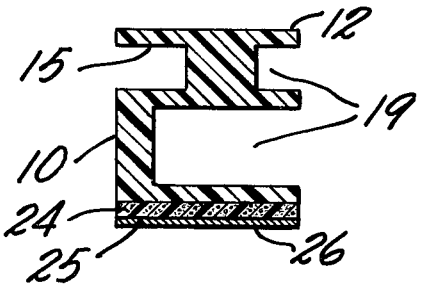
Figure 5:
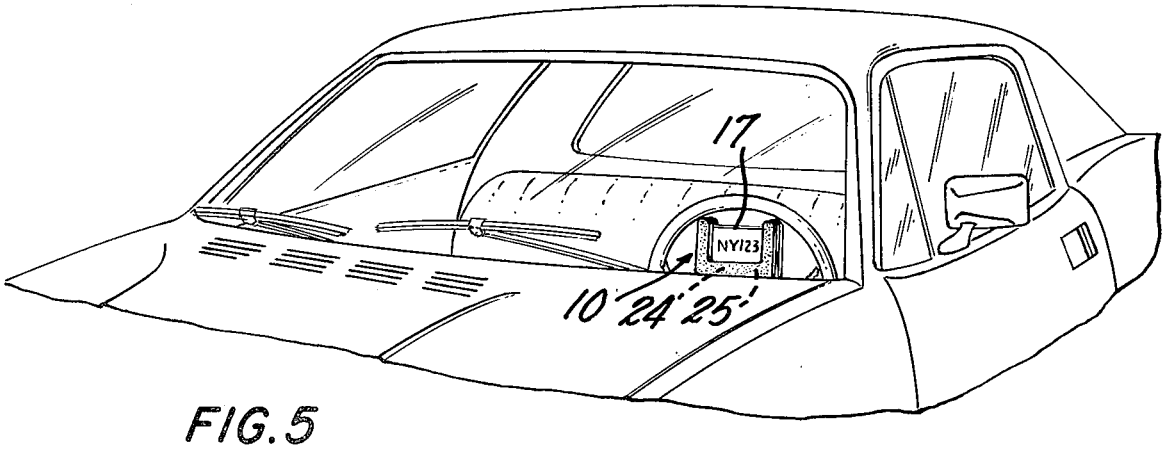

FIGS. 3 and 4 are cross-sectional views taken along the lines 3—3 and 4—4 of FIG. 1 looking in the direction of the arrows; and FIG. 5 is a front view of the holder of FIG. 1 mounted inside the windshield of an automobile.

Figure 2:
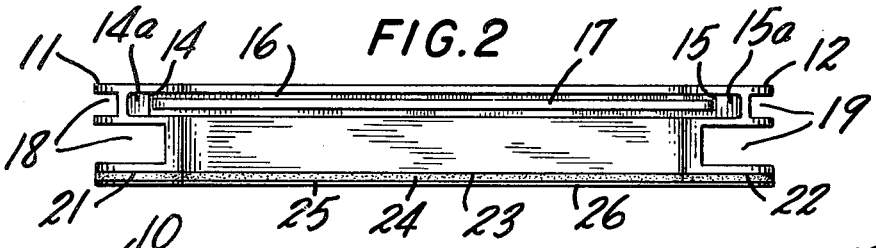
FIG. 2 is a top view of the holder of FIG. 1.

Referring first to FIGS. 1 through 4, the holder of the invention comprises a substantially U-shaped frame 10 having upright legs 11 and 12 and a bottom leg 13. The inside walls of the legs 11, 12 and 13 are formed with substantially coplanar grooves 14, 15 and 16 in which a removable registration card or plate 17 is adapted to be slidably received. To facilitate entry of the card 17 into the grooves 14 and 15, deepened groove portions **14*a* and 15*a* are provided at the tops of the legs 11 and 12, as shown in FIGS. 1 and 2**.

Preferably, the frame 10 is made of a light plastic material and the outsides of the legs 11, 12 and 13 are grooved at 18, 19 and 20 to lighten the frame and impart some flexibility to it while insuring its essential rigidity.

Secured on the front faces 21, 22 and 23 of the legs 11, 12 and 13 by a suitable adhesive is a layer 24 of flexible material such as a plastic foam. The layer 24 may be, say, ⅛ inch thick and it is coated with a pressure sensitive adhesive 25. For packing and shipping, the adhesive coating 25 may be protected by the usual peel-off covering 26.

The registration card 17 may be made of cardboard, inserted in a clear plastic protective sheath (not shown), if desired, and the car registration data may be prominently displayed on one side. Alternatively, the card 17 may be in the form of a rectangular plate made of suitable colored plastic to simulate a conventional license plate.

In use, the protective covering 26 is peeled off the adhesive coating 25, and the frame 10 of the holder is pressed against the inside face of the car windshield, as shown in FIG. 5. By virtue of the flexibility in the frame 10 and the flexible layer 24, the holder will readily accommodate itself to any curvature in the windshield. When the driver is in the car, he will insert the registration card, which he may carry in his wallet, into the holder where it will be prominently displayed. Whenever he leaves the car, he will remove the card and return it to his wallet.

The present invention not only provides for identification of a motor vehicle, but also is useful in the prevention and detection of motor vehicle thefts. If the rightful operator removes the registration card from the holder and takes it with him when he leaves the motor vehicle, no other person can operate the motor vehicle without the risk of being detected by the authorities who will notice the absence of a registration card from the holder. Accordingly, the likelihood that the motor vehicle will be taken by an unauthorized person is diminished.

In addition to deterring automobile theft, the present invention will reduce the likelihood of authorized operators and owners of motor vehicles operating a motor vehicle with a lapsed or expired registration card or with no registration card at all. The use of an expired registration card or the absence of any card at all will be noticed immediately by police officers and others charged with enforcing the motor vehicle laws. Upon so determining that a motor vehicle is being operated in violation of the traffic laws, the police officer can stop and summon the violator.

The representative embodiment described above and illustrated in the drawings is obviously susceptible of modification in form and detail within the scope of the following claims.

I claim:

1. A holder for an automobile identification card or the like comprising a substantially U-shaped frame having a bottom leg and a pair of free standing, spaced apart, upright legs mounted at the ends thereof with an opening therebetween, said frame being made of a light, flexible material and the outside side walls of the upright legs and the bottom side of the bottom leg being grooved lengthwise of said legs to provide rigidity with lightness, means forming in the inside walls of said upright legs substantially co-planar grooves defining a slot within which an automobile identification card is adapted to be removably received, the depths of said grooves being so dimensioned that the slot defined thereby is substantially wider at the upper end thereof than the card to facilitate its entry thereinto, and then narrows gradually to a width only slightly greater than the card, and a layer of flexible material affixed to an outside wall of said frame and coated with a pressure-sensitive adhesive to enable it to be secured to a supporting surface with said card-receiving slot substantially parallel thereto.

2. A holder as defined in claim 1 together with a substantially rectangular card removably mounted in the grooves in the frame and displaying prominently thereon the license identification of an automotive vehicle.

* * * * *